United States Patent [19]

Aubert

[11] 3,974,843

[45] Aug. 17, 1976

[54] WASHING MACHINE MORE ESPECIALLY FOR DENTAL INSTRUMENTS AND EQUIPMENT FOR MAKING DENTAL PROSTHESES

[75] Inventor: Michel Aubert, Geneva, Switzerland

[73] Assignee: Societe Distrembal SA, Paris, France

[22] Filed: July 25, 1975

[21] Appl. No.: 599,162

[30] Foreign Application Priority Data

June 23, 1975 France ..... 75.19530

[52] U.S. Cl. ..... 134/95; 134/92; 134/100; 134/115 R; 134/157; 134/200

[51] Int. Cl.[2] ..... B08B 3/04

[58] Field of Search ..... 134/92, 95, 100, 115 R, 134/115 G, 138–139, 157, 200

[56] References Cited

UNITED STATES PATENTS

| | | | |
|---|---|---|---|
| 1,398,022 | 11/1921 | Hopkins | 134/139 |
| 2,775,974 | 1/1957 | Coquyt | 134/139 |
| 2,994,330 | 8/1961 | Catlin et al. | 134/95 X |
| 3,087,504 | 4/1963 | Geschka | 134/95 X |
| 3,204,767 | 9/1965 | Borochaner | 134/115 R X |
| 3,727,620 | 4/1973 | Orr | 134/95 |

*Primary Examiner*—Robert L. Bleutge
*Attorney, Agent, or Firm*—Young & Thompson

[57] ABSTRACT

This invention relates to a washing machine for dental instruments comprising a frame structure housing a tank which may be closed by a lid, supplying pipes of said tank with water through a water treatment apparatus. A draining pump for said tank is provided, and an agitator for the water in the tank. A cylinder is rotatively and removably mounted in the tank and has a support which receives the instruments to be cleaned. A control device comprising a timer, push-buttons, valves and pressure gages controls the automatic washing cycle.

21 Claims, 10 Drawing Figures

FIG. 2
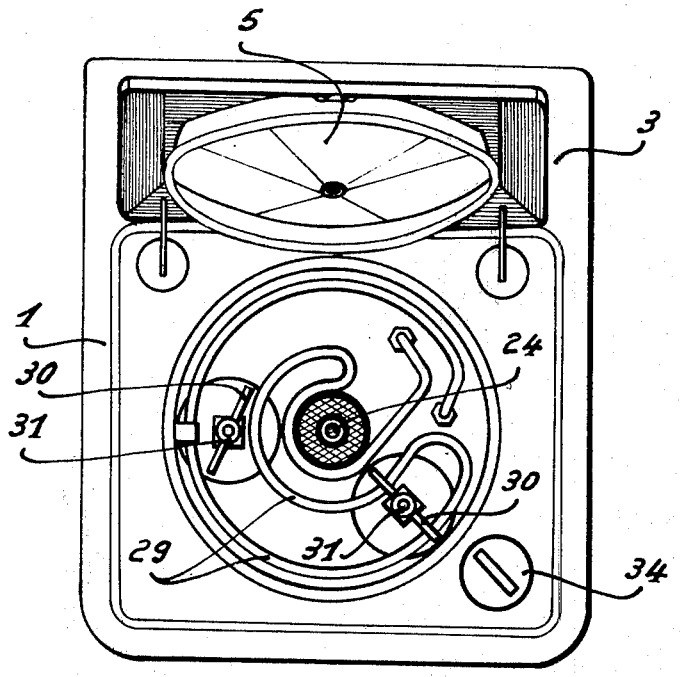
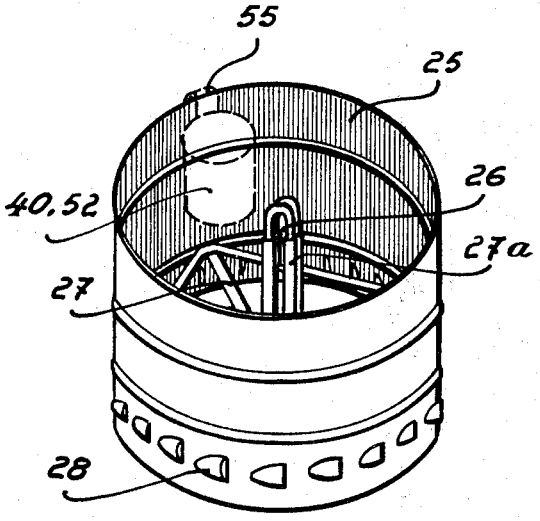
FIG.3
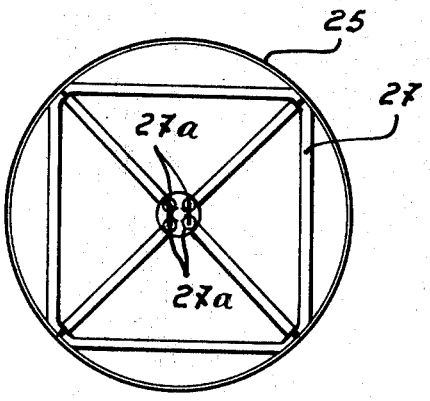
FIG.4

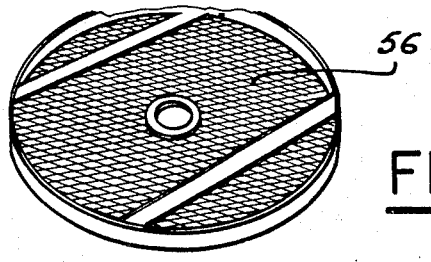
FIG. 5
FIG. 6
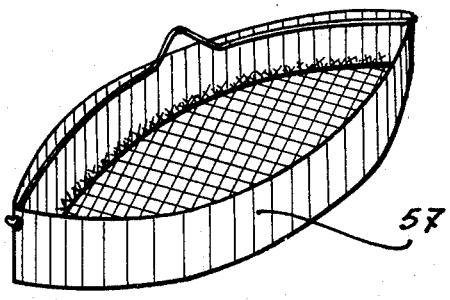
FIG. 7
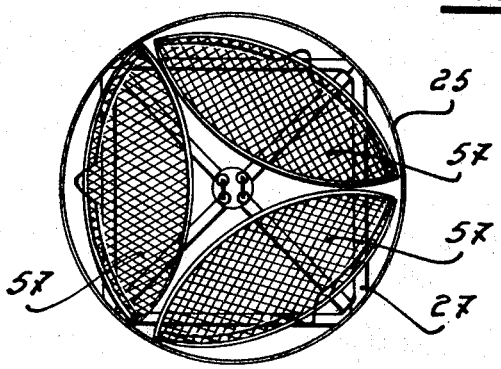
FIG. 8
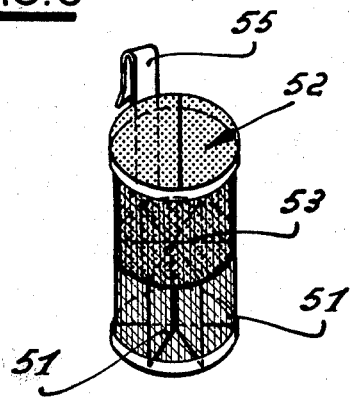
FIG. 9
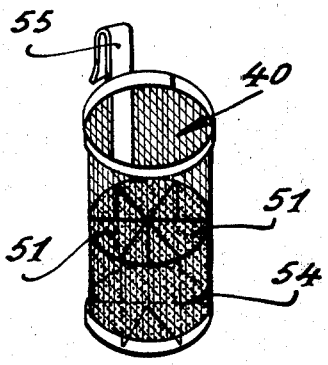

WASHING MACHINE MORE ESPECIALLY FOR DENTAL INSTRUMENTS AND EQUIPMENT FOR MAKING DENTAL PROSTHESES

The object of the present invention is to provide a washing machine, more especially for dental instruments and equipment for making dental prostheses.

This machine is characterised by the fact that it comprises a frame containing all the units of the machine, a tank fixed in the upper part of this frame and open at the top, a lid enabling the tank to be closed, at least one supply pipe intended to be connected to a running water supply and enabling the tank to be filled via a water treatment apparatus, an emptying pump for the tank, a removably mounted cylinder in the tank which rotates about a vertical axis, at least one support member for receiving articles to be washed and arranged so that it can be removably secured in the cylinder, and also at least one motor situated on the outside of the tank which drives, through the wall of this tank, a propeller situated in the tank under the said supports and eccentric with respect to the cylinder, wherein this propeller produces on the one hand a gyratory circulation of the liquid in the tank causing the cylinder to rotate, and produces on the other hand liquid pulsations and vibrations in all directions to create a strong localised turbulence in the tank which efficiently washes articles placed in the supports.

The accompanying drawings show diagrammatically and by way of example one embodiment of washing machine in accordance with the invention.

FIG. 2 is a view from above showing the interior of the tank.

FIG. 3 is a view, on an enlarged scale, of the cylinder.

FIG. 4 shows the cylinder from above.

FIG. 5 shows a first instrument support, which is in the form of a grating.

FIG. 6 shows a support in the form of a basket.

FIG. 7 shows in plan the cylinder provided with three baskets.

FIGS. 8 and 9 show supports in the form of cups.

Figure 1:
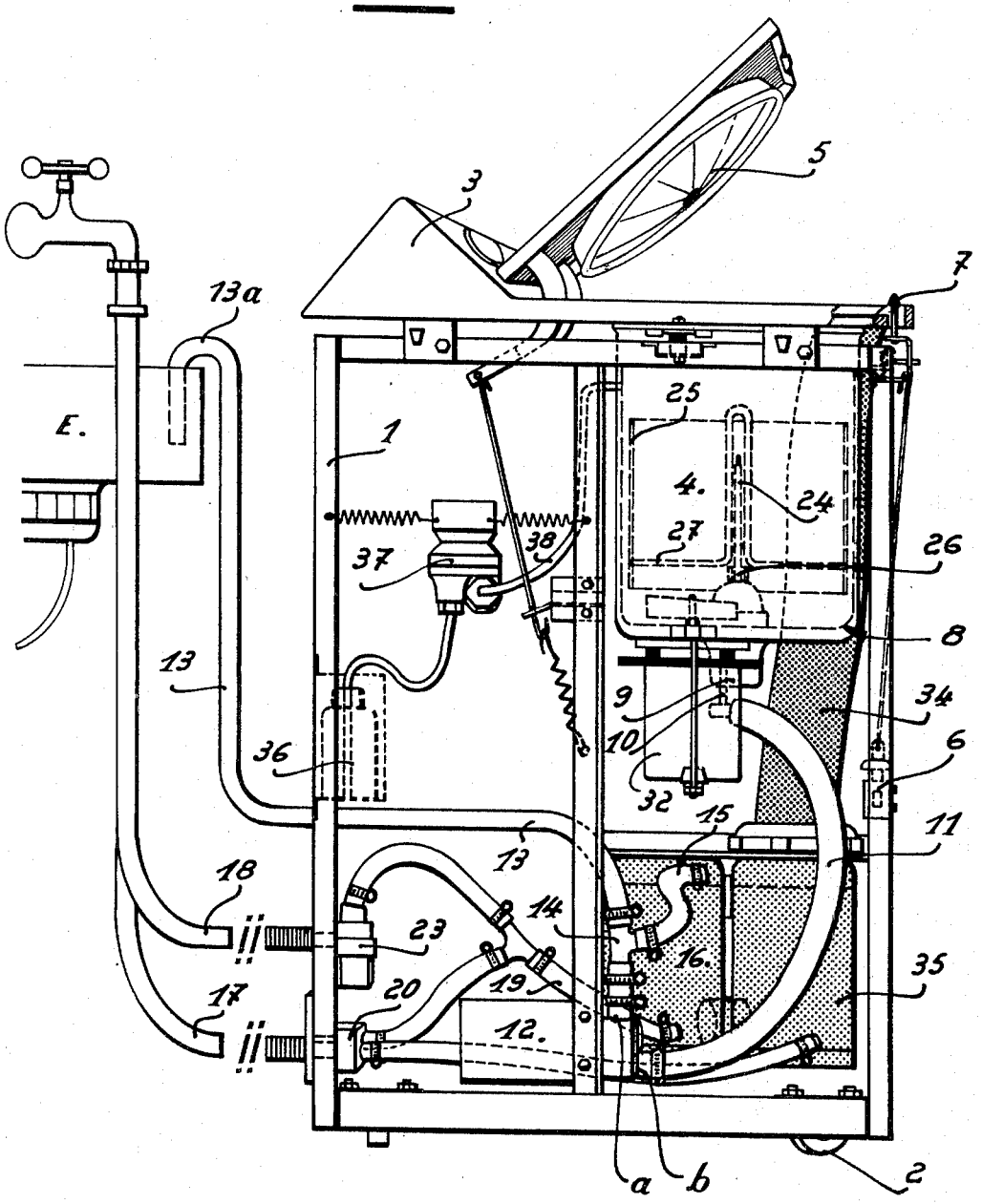
FIG. 1 is a side view of the washing machine, certain parts being shown in broken outline and cut away.

Referring to the drawings, the machine for washing dental instruments and equipment comprises a frame 1 supporting all the units of this machine. This frame 1 is generally mounted on wheels 2 to enable the machine to be moved easily.

This frame 1 contains an electro-mechanical control device in its upper part, which is located in a box unit 3 and enables the cycle of operations to be selected and controlled by the operator. A control panel contains the various switches and control devices for operating and controlling the washing machine.

The tank 4 is resiliently mounted, for example by means of silent blocks, in the upper part of the frame 1. This tank is open at the top and its purpose is to hold the washing and/or rinsing liquid for the articles being cleaned. This tank 4 is made of a material which is resistant to the chemical products used for the washing, for example stainless steel. This tank is provided with a lid 5 held under the action of a spring holding it in the open position. An electromagnet 6 controls the position of a locking catch 7 of the lid 5 in the closed position. This lid may be of stainless steel or plastics material and has a generally conical shape, wherein the tip of the cone projects into the tank. In this way the condensation which forms on the internal surface of the lid runs down and drops from the tip of the cone into the tank, following the axis of symmetry of the tank and thus following a line on which any article to be cleaned is placed.

The base 8 of the tank 4 contains a sump 9 generally centred on the axis of the tank 4, and from which extends a drain pipe. This drain pipe contains a short piece of small cross-section 10 followed by a pipe of large cross-section 11 terminating at the inlet of an emptying pump 12; the delivery from this pump 12 is connected to a flexible drain pipe 13 whose free end 13*a* has a U-shape and is placed in an outflow E.

The large cross-section pipe 11 has a volume such that when the emptying pump 12 is stopped the liquid contained in the flexible drain pipe 13 does not rise to the level of the tank 4. The presence of the short piece of drain pipe 10 having a small cross-section means that the dirty liquid in the large cross-section pipe 11 does not mix with the washing or rinsing liquid in the tank 4, even when the machine is working.

As will be seen hereinafter, the suction pipe 11 of this emptying pump (suction-delivery pump) 12 is arranged so that two other functions may be satisfied, namely filling of the tank 4 with water from the supply via a water treatment apparatus, and establishing the circulation for regenerating the water treatment apparatus. A three-way junction 14 is provided for this purpose, which is connected at the outlet *a* of the emptying pump 12 to a pipe 15 going to the outlet of the water treatment apparatus and to a flexible drain pipe 13. The inlet *b* of the pump 12 is connected to the drain pipe 11 joining the pump to the tank 4. The inlet to the water treatment apparatus 16 is fed with water from the water supply system. This water supply may comprise a single cold water pipe or, as shown, a cold water pipe 17 and a hot water pipe 18. The cold water pipe 17 feeds the inlet 19 to the water treatment apparatus via an electrically controlled double valve 20 which shuts off the supply or connects this water supply pipe 17 to the inlet 19 of the water treatment apparatus 16 or to the salt reservoir 35 for the regeneration of the water softening resin. This water treatment apparatus is generally a water softener but may consist of a a demineralising device in certain cases, which removes all the mineral salts and not only calcium carbonate from the water.

The hot water supply pipe 18, controlled by a valve 23, is also connected to the inlet 19 of the water treatment apparatus 16.

A pipe 34 connects a salt reservoir 35 to the top of the frame 1 of the machine and enables regeneration salts for regenerating the resin in the water treatment apparatus 16 to be added.

A central shaft 24 extends vertically from the base of the tank 4. This shaft is intended to act as a guide and rotation shaft for a stainless steel cylinder 25. This cylinder 25 is thus mounted in a rotatable and removable manner in the interior of the tank. The central bearings 26 of this cylinder are connected to the solid cylindrical wall 25 by a horizontal polygonal frame 27 which also serves as a base for supports for receiving the articles to be washed. The lower part of the cylindrical wall 25 comprises vanes 28 whose function will be described hereinafter. This frame 27 is made of steel wire and has a part 27*a* forming a vertical shaft carrying bearings which act in conjunction with the central shaft 24 for rotating the cylinder.

The free end of the flexible drain pipe 13 is intended to be fixed in a sink or outflow, whereas the supply pipes 17, 18 are intended to be connected respectively to hot and cold water taps.

A heating element 29 is fixed in the tank 4, approximately parallel to the base of the tank 4, and is supplied and controlled by the control device situated in the box unit 3 via electrical conducting means which pass in a liquid-tight manner through the wall of the tank.

The machine also comprises at least one propeller 30 which is rotatably driven through the base of the tank 4, either mechanically by a shaft passing in a liquid-tight manner through the base of the tank, or magnetically. In the example shown the drive shaft 31 of the 'turbine' is the shaft of an electric motor 32 mounted under and suspended from the tank 4. The engagement of the motor 32 is controlled by the electrical control device.

The propeller 30 has a concave-convex blade approximately perpendicular to its drive shaft 31. This propeller is arranged so as to form a reverse pitch helical blade beater. This beater is preferably aligned vertically and is situated between the base of the tank and the cylinder 25. This beater 30 is eccentric with respect to the tank 4.

On account of the particular shape of this beater 30, on the one hand a gyratory motion of the liquid in the tank is produced which causes the cylinder to rotate because of its vanes, and on the other a localised turbulence is produced which causes the liquid to vibrate. In this connection a baffle may be provided, mounted on the tank, to reinforce the effect of the beater.

In one variant a similar pulsatory, vortex and vibratory flow of the liquid may be created by using two rotating beaters (FIG. 2) turning in opposite directions to one another. Each of these beaters in this case comprises a rectangular blade parallel to the drive shaft of the beater and fixed to the shaft at its centre. In order to increase the gyratory movement of the liquid in the tank, a degree of assymmetry is created between the propellers or beaters, for example by decentring the blade of one of them, or by placing them at different distances from the centre or at different heights in the tank.

The machine also comprises supports, intended to be placed or mounted on the cylinder 25, for receiving the dental instruments or equipment for making dental prostheses.

FIG. 3 shows a cylinder provided with a cup 40 for taking drills. FIGS. 8 and 9 show two embodiments of cups.

FIG. 5 shows a basket 56 having a base in the form of a grating and intended to be placed in the cylinder 25, on the frame 27, and to hold dental instruments.

FIG. 7 shows the cylinder 25, seen from above, and provided with three baskets 57, shown in FIG. 6, which rest on the frame 27.

Figure 10:
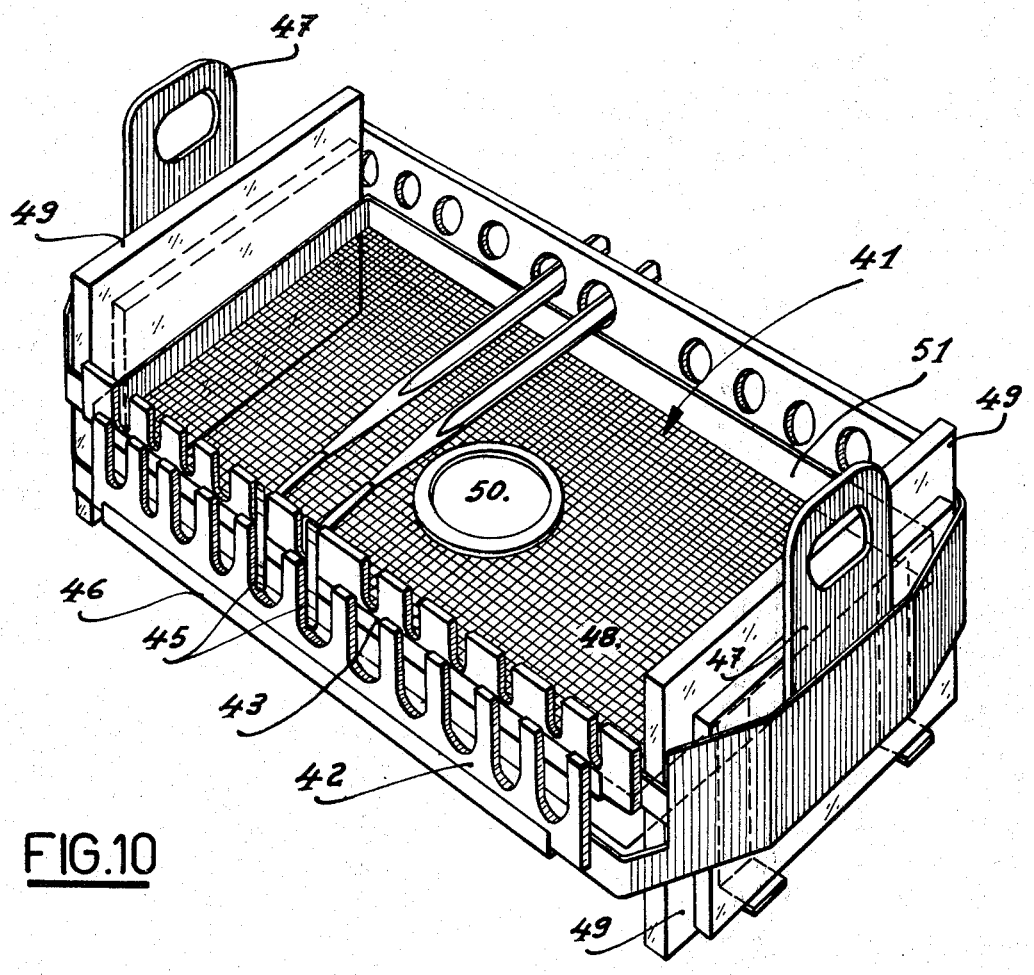
FIG. 10 shows a speculum support.

FIG. 10 shows a speculum basket 41, characterised by the fact that a double row of combs 42, 43, the rows being staggered with respect to one another, supports the specula 45 in a vertical position without the speculum as such being in contact with the teeth of the comb; this is to avoid the formation of drops which, on drying, would leave rings. The combs are of a plastics material so as not to scratch the parts of the instruments which they are in contact with. In order to prevent these combs changing shape under the action of the heat, the said combs may slide freely in a U-shape rail 46 and be held only by a central point. The plastics comb may then move either side of its attachment point without becoming deformed.

The handles 47 are made of a material having a very low heat transmission coefficient, polypropylene for example, so that the basket can be removed after the drying without burning the fingers. The method of securing these handles also prevents changes of shape due to the heat.

This basket is also characterised by the fact that it comprises a grid base 48 to receive delicate instruments such as probes and lancets, and its ends are provided with supports for the installation of cement concrete plates 49. A central aperture 50 allows the shaft 24 and vertical shaft of the cylinder 25 to pass through.

A third comb 51 arranged on the opposite side of the basket holds the handles of the specula.

FIG. 9 shows a drill basket 40 designed in such a way that the drills can be arranged loosely therein and can be removed easily without becoming entangled in the basket.

Furthermore, small compartments 51 are provided whose size is such that even the smallest drills, in particular the "counter-angle" drills, cannot lie in bundles or in the horizontal position, which would have a deleterious effect during drying and result in rust spots. The base of this cup is in the form of a grating and the lower part of its circumferential wall 54 is solid.

FIG. 8 shows a basket 52 for tubed instruments which has a solid base and a solid upper part to its casing 53, in order on the one hand to prevent the smallest instruments passing through the base, and on the other hand to facilitate the removal of instruments, the ends of the instruments not being in contact with the grating.

These two types of cups 40, 52 comprise a hook member 55 for attaching the cups to the wall of the cylinder 25 (see FIG. 3).

Two types of baskets are provided for washing common instruments such as forceps, lifting instruments, crushing instruments, scaling instruments, and spatulas, one basket 56 being circular in shape (FIG. 5) and able to hold loose and assorted instruments, the other basket 57 being of oval shape (FIG. 6) and of smaller size, enabling instruments to be separated into three batches (FIG. 7), each batch filling a basket, and the rotatory cylinder 25 being able to hold three juxtaposed baskets 57.

A device for injecting an antioxidant product comprises a product reservoir 36 and a membrane pump 37 for injecting a specific amount of product through the pipe 38 into the tank.

The electro-mechanical control device, located in the box unit 3, comprises a timer, a main switch, indicator means and push buttons controlling the electrical switches. This control device also comprises relays, switches, contacts, etc., necessary for the control of operations by the timer and following the "orders" given by means of the push buttons, valves 20, 23 of the motor 32, and also the pump 12. This device will not be described in more detail since it involves customary and well-proved techniques.

A push button enables the chosen cycle to be started, another push button enables the timer to be reset to zero at any time, a further push button enables a short or long wash time to be selected, and yet another push button enables a cycle including the injection of antioxidant product to be selected. Finally, another push button enables the lid to be opened by hand.

In one variant the water softener may be replaced by an apparatus enabling water to be demineralised. In some cases it is in fact desirable that the washes and above all the rinses are carried out with demineralised or distilled water in order to avoid any deposits of lime or other minerals in the bath or on the instruments being cleaned.

It should be noted that one of the essential features of this washing machine is the method of agitating the liquid in the bath. In fact, by virtue of using a reverse pitch turbine or two turbines close to one another which rotate in opposite directions, liquid pulsations or vibrations in all directions are obtained in at least one region of the tank. These pulsations cause the liquid in the tank to vibrate and result in a very efficient wash. It should be noted that the cylinder 25 is caused to rotate at the same time as a result of the gyrational component force transmitted to the liquid in the tank.

The operation of the machine described is as follows:

The operator connects the water pipes 17, 18 to hot and cold water taps and places the drain pipe 13 in the outflow. The operator then connects the control device to the electricity circuit via a cable (not shown) and switches on the main switch.

The operator next selects, using the push buttons, the desired cycle.

The operator places the instruments to be cleaned in the supports in the cylinder, places the cylinder in its operating position in the tank, and closes the latter with the lid 5.

Assuming that the taps are "on", the operator may then push the "start" button, thereby starting a wash cycle.

A complete wash cycle including drying comprises the following successive operations:

1. Placing the various baskets and supports containing the instruments to be washed in the cylinder 25 which is then itself placed in the tank 4.

2. The operator adds an amount of detergent by hand to the tank and then shuts the lid 5 of the tank 4.

3. By actuating the valve 20 to supply the softener 16 with cold water, the resin in the water treatment apparatus is rinsed. The pump 12 is actuated and the brine is thus removed by the pipe 15 and the flexible drain pipe 13. The inflow of cold water is then turned off and the pump 12 is stopped.

4. By actuating the valve 23 hot water is supplied to the tank 4 by the pipe 19, the softener 16, and the pipes 15 and 11. The valve 23 is deactuated when the desired level is reached in the tank 4. A pressure gage is provided to automatically stop the filling process.

5. The motor 32 of the beater 30 and the heating member 29 are switched on. This washing action resulting from the turbulence and vibration of the liquid proceeds in accordance with a cycle which is governed by the timer, and then the wash solution is drained and passes to the outflow via the drain pipe 11, the pump 12 and the flexible drain pipe 13.

6. The valve 20 is actuated to supply the tank with cold water from the softener 16. Once the desired level is reached in the tank a pressure gage deactuates the valve 20 and stops the supply of water. The motor 32 is switched on and causes a first rinse whose duration is determined by the timer. The rinsing solution is drained in the same way as the wash solution described in (5) above.

7. A second rinse identical to the first is carried out.

8. An intermediate rinse operation on the resins in the softener 16 is carried out as in (3) described above.

9. A third rinse is performed, during which the heating unit 29 is switched on and a batch of antioxidant product is injected into the tank by the pump 37. The rinsing solution is then drained by the pump 12, controlled by the timer, once the rinsing time has finished.

10. The timer actuates the electro-magnet 6 and causes the lid 5 to open.

11. The new regeneration of the water softener is performed by opening the valve 20 to supply the salt reservoir 35 with fresh water, thereby causing a small amount of brine to enter the softener 16.

12. The pump 12 is switched on for a few moments to empty the overflow of the water softener 16.

13. The timer intermittently switches on the heating unit 29 in order to dry the washed and rinsed instruments.

Numerous variations, both as regards the wash program cycle and the constructional details of the machine described may be considered without going beyond the scope of the claimed patent protection.

Of course, various modifications may be carried out by one skilled in the art to the machine which has just been described solely by way of non-limiting examples, without going beyond the scope of the invention.

I claim:

1. Washing machine for instruments, in particular dental instruments and equipment for making dental prostheses, characterised by the fact that it comprises a frame containing all the units of the machine, a tank fixed in the upper part of this machine and open at the top, a lid enabling the tank to be closed, at least one feed pipe intended to be connected to a running water supply and enabling the tank to be filled via a water treatment apparatus, a tank emptying pump, a removably mounted cylinder in the tank which rotates about a vertical axis, at least one support member for receiving articles to be washed and arranged so that it can be removably fixed in the cylinder, and also at least one motor situated on the outside of the tank which drives, through the wall of this tank, a propeller situated in the tank under the said supports and eccentric with respect to the cylinder, wherein this propeller produces on the one hand a gyratory circulation of the liquid in the tank which causes the cylinder to rotate, and on the other hand liquid pulsations and vibrations in all directions in order to create a strong localised turbulence in the tank which efficiently washes articles placed in the supports.

2. Machine according to claim 1, characterised by the fact that it also comprises a device for injecting an antioxidant product into the tank, said device comprising a container for this product and a membrane pump.

3. Machine according to claim 2, characterised by the fact that it comprises cylindrical cups which can be hooked to the wall of the cylinder and are intended to hold drills or other small instruments.

4. Machine according to claim 3, characterised by the fact that the cups are subdivided into several sectors, thereby preventing the drills from lying on the floor of the cup.

5. Machine according to claim 4, characterised by the fact that the cup comprises a solid base and a partially solid and partially perforated side wall, the solid part being situated above the perforated part.

6. Machine according to claim 4, characterised by the fact that the cup comprises a perforated base and a partially solid side wall, the solid part being situated below the perforated part of this wall.

7. Machine according to claim 1, characterised by the fact that it comprises a hot water pipe and a cold water pipe, each of the two water pipes being connected to the tank via the water treatment apparatus, and by the fact that the cold water pipe is also connected to a salt reservoir for regenerating the resin in the water treatment apparatus.

8. Machine according to claim 1, characterised by the fact that the lid is under the action of a spring holding it open, and under the action of a catch controlled by an electro-magnet keeping the lid closed during the washing and rinsing operations.

9. Machine according to claim 1, characterised by the fact that it comprises an emptying pump whose delivery is connected to a flexible drain pipe and whose suction action is connected to the tank.

10. Machine according to claim 9, characterised by the fact that the connection between the tank and the suction unit of the pump comprises a section of small diameter and length which is integral with the base of the tank, and a pipe of large diameter which joins this section to the pump.

11. Machine according to claim 10, characterised by the fact that the suction unit of the pump is also connected to the outlet of the water treatment apparatus.

12. Machine according to claim 1, characterised by the fact that it comprises two beaters caused to rotate in opposite directions to one another by one or two motors.

13. Machine according to claim 12, characterised by the fact that the beaters are driven by the motors by means of a magnetic coupling through the tank.

14. Machine according to claim 1, characterised by the fact that the tank is mounted on the frame by means of silent blocks.

15. Machine according to claim 1, characterised by the fact that the cylinder comprises a solid wall having vanes in its lower part, and by the fact that it comprises a central bearing connected to the wall of the cylinder by a polygonal frame lying in a plane perpendicular to the axis of the cylinder.

16. Machine according to claim 15, characterised by the fact that a support for instruments consists of a grating removably placed on the polygonal frame of the cylinder.

17. Machine according to claim 15, characterised by the fact that the support for instruments consists of a basket whose base is formed by a grating intended to be placed on the frame of the cylinder.

18. Machine according to claim 17, characterised by the fact that the cylinder is adapted to take three supports in the form of oval baskets.

19. Machine according to claim 1, characterised by the fact that it comprises a speculum support intended to be placed in the cylinder, said support having a base in the form of a grating and at least two combs made of plastics material which hold the speculum in such a way that no part of said combs is in contact with the reflecting surfaces of the speculum.

20. Machine according to claim 19, characterised by the fact that the speculum basket comprises handles of plastics material and slide means intended to receive glass plates.

21. Machine according to claim 1, characterised by the fact that it comprises a single turbine and a baffle means which increases the turbulence of the liquid and its vibration and counteracts its gyratory movement.

* * * * *